United States Patent [19]

Mansfield

[11] 4,091,748

[45] May 30, 1978

[54] METHOD AND APPARATUS FOR PRODUCING GAS FROM SOLID MUNICIPAL WASTE

[75] Inventor: Vaughn Mansfield, Gallatin, Tenn.

[73] Assignee: Mansfield Carbon Products, Inc., Gallatin, Tenn.

[21] Appl. No.: 747,192

[22] Filed: Dec. 3, 1976

[51] Int. Cl.[2] ..... F23G 5/00

[52] U.S. Cl. ..... 110/228; 110/234

[58] Field of Search ..... 201/27, 32; 110/8 R, 110/10, 15, 116, 118, 165 R, 49 R

[56] References Cited

U.S. PATENT DOCUMENTS

| | | | |
|---|---|---|---|
| 2,015,842 | 10/1935 | Christensen | 110/15 |
| 3,317,202 | 5/1967 | Cates, Jr. et al. | 110/15 |
| 3,556,025 | 1/1971 | Holley | 110/8 |
| 3,745,941 | 7/1973 | Reilly | 110/15 |
| 3,922,974 | 12/1975 | Hempelmann | 110/165 |

*Primary Examiner*—Kenneth W. Sprague

*Attorney, Agent, or Firm*—Littlepage, Quaintance, Murphy, Richardson and Webner

[57] ABSTRACT

Solid municipal waste refuse is pre-treated by partial burning in a moving grate hot carbonizer furnace and then further burned on a reciprocating step-grate stoker in the same furnace chamber. Limited amounts of air are fed to the waste through the grates to avoid the formation of hot spots in the burning material, thereby preventing the formation of clinkers and restricting the burning of volatile matter in the refuse. Hot low-Btu gas exhausted from the furnace chamber is burned in a boiler.

7 Claims, 2 Drawing Figures

METHOD AND APPARATUS FOR PRODUCING GAS FROM SOLID MUNICIPAL WASTE

RELATED APPLICATIONS

Mansfield APPARATUS AND METHOD FOR PRODUCING GAS, filed concurrently herewith.

FIELD OF INVENTION

Distillation: Apparatus, Horizontal, Plural gas and/or air admission.

PRIOR ART

Mansfield U.S. Pat. No. 3,434,932; Kay 1,913,396; Wagner 3,126,846; and Kato et al 3,863,578; "Purox" and "Andco-Torrax" systems.

OBJECTS

The broad objectives of the invention are three-fold, the first being to reduce solid municipal waste to sterile ash, second, to produce a hot low BTU gaseous by-product utilizable in adjacent boiler and, third, to avoid the formation of localized "hot spots" in the material being treated, thereby avoiding the formation of clinkers while avoiding unnecessary burning of the volatile matter in the material being treated. To accomplish the foregoing, the raw material is first transported horizontally in static-bed form through part of a hot carbonizing furnace, e.g., on a chain grate through which limited amounts of air are fed so as to maintain limited combustion of the material in the bed and to limit the temperature rise of the material, comparably with part of the coking process of Mansfield (supra). Within the same hot carbonizer furnace chamber is a horizontal reciprocating step grate upon which the partly carbonized material from the chain grate is dropped. As the then slow-burning material cascades down the step-grate, being crowded off one step onto the other by the reciprocating movements of the steps, hot pre-treated air is fed upwardly through the agitated material in closely-controlled, very limited amounts. Enough, but only enough burning is permitted, by close control of the airfeeds, to drive off hot-Btu gases from the material without burning any more of them than is necessary, while burning the hydrocarbons in the material so as to reduce it to sterile ash; and by keeping the material constantly on the move and shifting while it undergoes the hottest treatment, hot spots and resultant localized burning and formation of clinkers by glass and other meltable content of the material is avoided.

These and other objects will be apparent from the following specification and drawing, in which.

Figure 1:
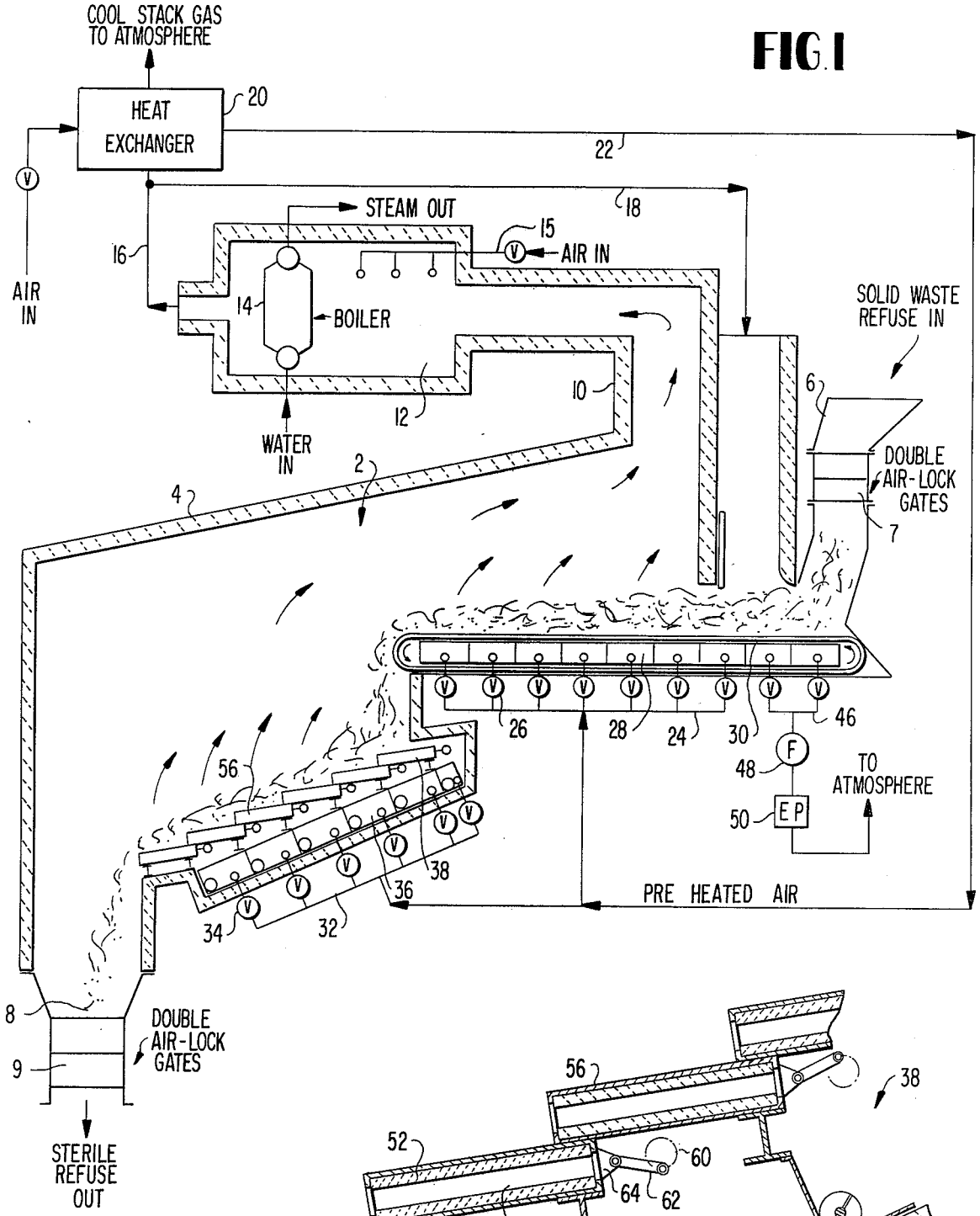
FIG. 1 is a diagrammatic vertical cross-section through the apparatus.
Figure 2:
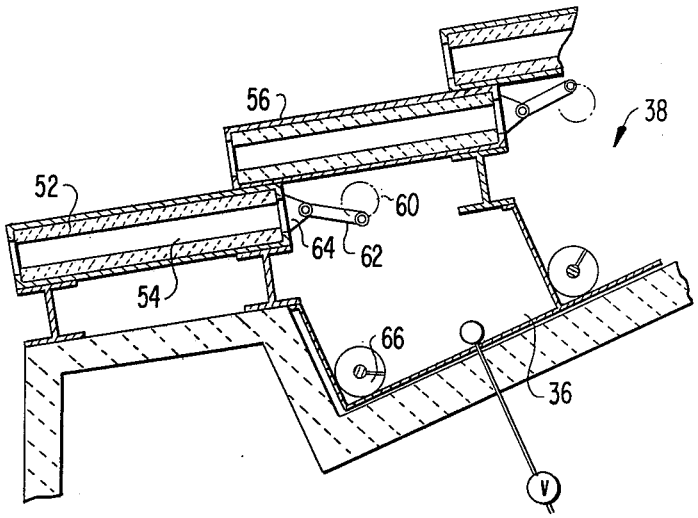
FIG. 2 is an enlarged fragmentary view illustrating the operation of the grate and air feed therethrough.

Referring now to the drawing, in which like reference numerals denote similar elements, the hot carbonizer furnace 2 has ceramic walls, a raw material infeed 6 which includes double air-lock gates 7 and a treated material outlet 8 which also has double air-lock gates 9 so that, as will be detailed hereinafter, a very limited and closely controlled feed of air to the material being treated can be maintained. Low Btu gas at about 1800° F is exhausted via the flue 10 to a furnace chamber 12 for a boiler 14. An air feed 15 is provided for burning with the hot Btu gases which are exhausted via a conduit 16. Part of the still hot spent exhaust gases are bled off and fed back via a line 18 to the input end of the furnace for preheating and driving the moisture off the incoming material as described hereinafter. The remainder of the hot spent exhaust gases are cooled while passing through a heat exchanger 20 to the atmosphere. Atmospheric air which is heated in the heat exchanger 20 is fed via a line 22 to a manifold 24 and thence through control valves 26 to the zones 28 of an airbox from which air is fed upwardly through a horizontal chain grate 30 to the material being transported thereon through the furnace. Other of preheated air is fed to a manifold 32 and thence through control valves 34 to the zones of an airbox 36 which underlies a reciprocating-step stoker grate 38, on which final treatment of the material takes place.

The raw material incoming to the furnace is deposited on chain grate 30, on which it is spread by a vertically adjustable conventional spreader gate 40 to form a bed, preferably about four feed in thickness. However, before passing beneath spreader gate 40 the incoming material is preheated and all the moisture is driven off by hot spent exhaust gases from line 18 which are fed downwardly through a flue 42 and down-drafted through the incoming material. Valves 44 control the flow of downdraft gases to a manifold 46 from which they are drawn by fan 48 and fed through an electrostatic precipertator 50 to the atmosphere.

As the material progresses through the furnace chamber on chain grate 30, sufficient preheated air is fed upwardly therethrough from the air box zones in quantities to ignite the bed completely through, from top to bottom, by the time the material reaches the end of the chain grate, so as to drive off volatile matter from the material in the form of low BTU gases. Solid municipal waste is known to have a value of about 5000 Btu per pound. By closely controlling the air feed through the air box zones, in both the chain grate and the stepped stoker grate phases of the treatment, the formation of zones of intense burning in the material is avoided, this being desired so that the glass and metal content of the material do not melt and form clinkers.

The incandesent material dropping off the end of chain grate 30 cascades downwardly onto the reciprocating ceramic grate steps 52 which have air passages 54 for transmitting air from the airbox zones 36 to the material cascading down the steps. The ceramic steps are preferably provided with metallic bearing surfaces 56 so as to reduce wear as they reciprocate upon one another and upon supporting cross beams 58. The ceramic steps are reciprocated by rotating crank shafts 60 which they are connected by rods 62 which extend from gear 64 on the steps to the throws of the crank shafts 60. Stokers of this general type are known in the art. In this case, the air feed to airbox zones 36 is controlled so as to complete the burning of the solid material and reduce it to sterile ash. However, this is a "starved" air feed so as to reduce to the greatest extent possible the burning of gases within the furnace 2 and thereby preserve the burnable gases for combustion in the boiler chamber 12.

Screw conveyors 66 are provided in the lower corners of the zones of airbox 36 so as to carry off ash residue which works its way through the reciprocating steps of grate 38.

Assuming a value of about 5000 Btu per pound of solid municipal waste entering the furnace, about 120,000 pounds of steam per hour is recoverable, assuming an overall conversion efficiency of about 73.6% to usable steam, or about 92% to a low Btu gas. A boiler efficiency of about 80% is assumed for converting the low Btu gas to steam. The make-up of the low Btu gas is as follows:

| | | |
|---|---|---|
| $CO_2$ | 7.6 | Estimated 131 Btu/SCF |
| CO | 28.6 | |
| $H_2$ | 11.6 | |
| $CH_4$ | 1.8 | |
| $O_2$ | .4 | |
| $N_2$ | 50.0 | |

The solid material emerging through outlet 8 is in the form of sterile refuse which can easily be disposed of. The gases exhausted to the atmosphere are cool and relatively devoid of noxious odors or gases as compared with incinerators, and the capital cost of the system is sufficiently low as to render it economically feasible. It is estimated that a plant wherein the grates are about 12 feet wide and wherein the chain grate is about 15 feet long running at 10 to 15 inches per minute can handle about 400 tons of solid municipal waste refuse per 24 hours.

Alternate fuels, such as bagasse, lignite, wood chips, peat, sub-bituminous and bituminous fuels may be used in the apparatus. Where moisture content of the starting material is so low to present no problem of reporting into the output gas stream, the downdrifting step may be eliminated.

I claim:

1. Apparatus for producing gas from solid municipal waste comprising, in combination a furnace having a chamber, an elongate horizontally moving grate therein, infeed means for depositing material onto one end of said horizontally moving grate, a reciprocating step grate having an upper end disposed below the other end of the horizontally moving grate for receiving said material as the latter drops off the other end thereof, outfeed means for receiving material dropping off the lower end of the reciprocating step stoker, air lock means for said infeed and outfeed means for restricting the passage of air therethrough into said furnace chamber, zoned airbox means beneath said grates, means for feeding controlled amounts of air to the material on said grates through the zones of said airbox means, an exhaust conduit leasing from said furnace chamber, and a boiler having a combustion chamber connected to said exhaust conduit for burning gases exhausted from said furnace.

2. The apparatus defined in claim 1, said elongate horizontally-moving grate comprising an endless chain grate.

3. The apparatus claimed in claim 2, and means for downdrafting hot spent gas from said boiler conbustion chamber through a flue which lies between the infeed means and the furnace chamber and thence through the material on said horizontally moving grate adjacent said infeed means, and thence to the atmosphere whereby to drive off moisture therefrom and prevent the same from reporting into the gases exhausted through said conduit to said boiler.

4. The apparatus as claimed in claim 3, and a vertically-adjustable spreader gate means depending from the side of said flue which is disposed towards the furnace chamber.

5. The method of producing sterile ash refuse and steam from solid municipal waste which comprises infeeding said waste into a hot closed furnace chamber, partly oxidizing said waste by transporting the same in static-bed form on a horizontally moving grate across part of said chamber while feeding air upwardly therethrough while driving off gases therefrom into said furnace chamber, completing the oxidation of said waste and thereby reducing the same to sterile ash and driving off additional gases therefrom by dropping the same off the horizontally moving grate onto the upper end of a reciprocating step grate and cascading the same downwardly and across said furnace chamber in agitated-bed form while feeding air upwardly therethrough, controlling the air feeds to the material on said grates so as to minimize the oxidation in the furnace chamber of the gases driven off of the waste, outfeeding the sterile ash from the bottom of said chamber, exhausting the driven-off gases from the furnace chamber to a boiler and burning the exhausted gases in the boiler to produce steam.

6. The method as claimed in claim 5, wherein the temperature of said material attained by the partial oxidation thereof in static bed form is about 1800° F.

7. The method as claimed in claim 5, and minimizng the entrance of air into the furnace chamber with the infeed waste and though the outfed ash.

* * * * *

UNITED STATES PATENT AND TRADEMARK OFFICE

CERTIFICATE OF CORRECTION

PATENT NO. : 4,091,748

DATED : May 30, 1978

INVENTOR(S) : Vaughn Mansfield

It is certified that error appears in the above-identified patent and that said Letters Patent are hereby corrected as shown below:

Column 3, Line 29, correct the spelling of "downdrafting".

Column 3, Line 51, delete "leasing" and insert --leading--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*